US005826413A

United States Patent [19]

Bostock et al.

[11] Patent Number: 5,826,413

[45] Date of Patent: Oct. 27, 1998

[54] SAFETY STIRRUP

[75] Inventors: Hayden Gregory Bostock, Moonee Ponds; Ashley Charles James Snook, Fairview Heights; Peter Zillmer, Smithfield, all of Australia

[73] Assignee: Saferider Australia PTY Ltd., Australia

[21] Appl. No.: 605,191

[22] PCT Filed: Jun. 6, 1995

[86] PCT No.: PCT/AU95/00332

§ 371 Date: Feb. 23, 1996

§ 102(e) Date: Feb. 23, 1996

[87] PCT Pub. No.: WO96/00185

PCT Pub. Date: Jan. 4, 1996

[30] Foreign Application Priority Data

Jun. 27, 1994 [AU] Australia ..... PM 6461

[51] Int. Cl.[6] ..... B68C 3/02

[52] U.S. Cl. ..... 54/49

[58] Field of Search ..... 54/47, 49

[56] References Cited

U.S. PATENT DOCUMENTS

| | | | |
|---|---|---|---|
| 535,870 | 3/1895 | Taylor | 54/49 |
| 1,000,782 | 8/1911 | Cox | 54/49 |
| 1,276,540 | 8/1918 | Kall | 54/49 |

FOREIGN PATENT DOCUMENTS

| | | |
|---|---|---|
| 39229/85 | 9/1985 | Australia . |
| 62109/90 | 3/1991 | Australia . |
| 65714 | 12/1982 | European Pat. Off. . |
| 2003387 | 7/1971 | Germany . |
| 3934810 | 10/1990 | Germany . |
| 2183437 | 6/1987 | United Kingdom . |

*Primary Examiner*—Robert P. Swiatek

*Attorney, Agent, or Firm*—Knobbe, Martens, Olson & Bear LLP

[57] ABSTRACT

The invention relates to a safety stirrup for use with horses which prevents a rider's foot from being caught in the stirrup in the event of inadvertent dismounting of the rider. The stirrup consists of a foot support pivotably held within a mounting member. The foot support can be released at an end from the mounting member and portions of the foot support are separable so that a trapped foot can be released.

16 Claims, 2 Drawing Sheets

SAFETY STIRRUP

TECHNICAL FIELD

This invention relates to horse riding stirrups and is particularly concerned with safety stirrups which prevent the rider's foot from being caught in the stirrup in the event of the inadvertent dismounting of the rider such as being thrown from the horse.

BACKGROUND ART

Known types of stirrups generally include a D-shaped metal structure with a slot located in the centre of the arcuate portion of the D to enable the stirrup to be attached to a stirrup strap. In use, the rider's foot is inserted into the stirrup such that a base portion defined by an inner surface of the upright of the D of the stirrup locates against the sole of the rider's foot and the arcuate portion of the stirrup locates against the top of the rider's foot. In this way the rider's foot is held in place and is not easily dislodged from the stirrup when the gait of the horse increases.

A disadvantage of existing stirrups is that in the event of the rider falling from the saddle, one of the rider's feet can become caught in the stirrup. This is particularly the case when a rider is thrown from the horse, the swiftness of which does not allow the rider to extract a foot caught in a stirrup. Catching of a foot in a stirrup can cause serious injury to the rider since the rider may be dragged along beside the horse.

Safety stirrups have previously been devised to overcome some of these problems. One form of safety stirrup includes a frangible or weakened portion of the stirrup located adjacent to the stirrup strap attachment slot. In use, this frangible portion is designed to break away if the rider's foot is caught in the stirrup when the rider is thrown from the saddle.

This frangible stirrup is satisfactory in that the rider is saved from further injury which may be caused by being dragged along the ground. However, the rider cannot easily remount, since the saddle now has only one operable stirrup and the rider may be thrown from the saddle again should the horse increase its gait. Hence the rider should replace the broken frangible stirrup before continuing, which may be inconvenient or impossible.

Also, the frangible stirrup often does not prevent the rider from suffering leg injuries. Hence, they are only of limited benefit for novice or disabled riders. A further disadvantage of these stirrups is that they are more bulky than conventional stirrups in the region of attachment to the stirrup strap and this increased bulk often causes wear to the rider's clothing.

An alternative form of safety stirrups is disclosed in Australian Patent Application No. 62109/90. In this stirrup, the foot is held in a restraint which separates when the restraint is pivoted out of the normal position of the restraint with a rider mounted on a horse. This pivoting will occur when the rider is thrown from the horse and the separation of the restraint results in release of the foot from the stirrup. A disadvantage of the stirrup described in 62109/90 is that a foot must be placed in the stirrup from a particular side for the release mechanism to operate. Use of the stirrup with the foot inserted from the wrong side prevents operation of the release mechanism.

SUMMARY OF THE INVENTION

It is an object of the present invention to provide a stirrup which alleviates or overcomes the disadvantages of existing stirrups.

According to the present invention there is provided a safety stirrup comprising:

an inverted U-shaped mounting member having means located in the arcuate portion of the U to enable a stirrup strap to be attached thereto;

a foot support pivotally mounted between the extremities of the mounting member when the stirrup is in normal use, wherein the foot support comprises a tread having an extension projecting upwardly from each end of the tread, and a foot upper restraining portion comprising two arms which co-operate together to form a looped configuration extending from the extensions formed on the tread, each said arm being pivotal outwardly from its adjacent support extension; and co-operating engagement means between the foot upper restraining portion and the inverted U-shaped mounting member to retain the foot upper restraining portion in a plane within the inverted U-shaped mounting member when the stirrup is in said normal use and to thereby prevent the arms of the foot upper restraining portion from pivoting outwards;

wherein said foot support is releasable from said pivotal mounting at one extremity of said mounting member after pivoting of said foot support from the normal in use arrangement and the other extremity of said mounting member is pivotal outwardly, and wherein said pivoting of the foot support from the normal in use arrangement enables the arms of the foot upper restraining portion to pivot outwardly and/or said foot support to release from said one extremity of said mounting member.

The term "normal use" is used in the preceding paragraph and hereafter to denote the configuration of the stirrup when a rider is mounted on a horse to which the stirrup is fitted with the rider's foot positioned in the stirrup.

The pivotal mounting of the foot support to the mounting member is typically by way of shafts or pins. Preferably, the pins or shafts extend from, or are received by, the extensions projecting from the tread.

In the case of the pivotal mounting of the foot support which is releasable from one extremity of the mounting member, the pivot typically comprises a pin projecting from the foot support which is received by an aperture in the mounting member. To effect release from the mounting member, the pin can be provided with flattened portions which on rotation of the foot support, allow the pin to pass through a slot in the mounting member between the aperture and the edge of the mounting member. To aid release of the pin, the walls of the slot preferably flare outwardly away from the aperture. The angle between the slot walls is typically about 45°.

In a preferred embodiment, the pin described in the preceding paragraph has a head which prevents excessive spreading of the extremities of the mounting member when the pin is located in the aperture in the mounting member. Advantageously, the head stands slightly away from the adjacent surface of the mounting member to provide a gap therebetween when the pin is located in the aperture. Depending on the nature of the cooperating engagement means between the foot upper restraining portion and the mounting member, the aforementioned gap can facilitate disengagement of the foot upper restraining portion and the mounting member by allowing spreading of the extremities of the mounting member.

In preferred embodiments where the pivotal mounting of the foot support to an extremity of the mounting member includes a pin having a head, a recess is typically provided in the mounting member around the aperture therein, which recess can receive the head of the pin when the pin is located in the aperture. The bulk of the head advantageously lies within the recess resulting in the mounting member having a substantially smooth outer surface.

In the case of the pivotal mounting of the foot support to the other extremity of the mounting member, the mounting preferably comprises a screw which passes from the exterior of the stirrup through the U-shaped mounting member to be threadingly engaged by the foot support. The screw is typically contained within a dual diameter cavity in the mounting member with the screw having an enlarged head which recesses into the wider diameter cavity. The screw threaded portion of the screw is suitably formed on a narrower diameter section at the end of the screw.

The foot upper restraining portion is preferably arcuate in shape and the arms preferably cooperate in a male/female arrangement. This typically comprises an integrally formed pin extending from the tip of one of the arms of the foot upper restraining portion which is accommodated in a complementary shaped recess formed in the tip of the other of said arms.

The co-operating engagement means is preferably a projection formed on each arm of the foot upper restraining portion, adjacent to the pivotal connection with the support extension, and an aligned socket formed in the inwardly facing arms of the inverted U-shaped mounting member. The projection is suitably maintained within the socket to thereby prevent pivotal rotation of the foot upper restraining means from the plane of the mounting member during normal use, by spring-biasing the sides of the mounting member against the restraining means. The projections could equally well be formed on the inwardly facing sides of the mounting member with corresponding sockets formed in the foot upper restraining portion.

The pivot between a restraining portion arm and adjacent projecting extension, and the other extremity of the mounting member and the remainder of the mounting member, typically comprises interdigitating elements through which a pin is passed. The interdigitated elements help to maintain the integrity of the stirrup when in the normal in use arrangement.

The means for locating the stirrup strap in the mounting member can be a conventional arrangement such as a slot through which the strap is threaded, or a known toggle-type connection. The former arrangement is preferred.

Suitably, the tread of the foot support is in the form of a cast plate or slotted plate which is oriented in a generally horizontal plane in use. Preferably the extensions formed on the tread are walls which are integrally formed with the ends of the tread.

BEST MODE AND OTHER MODES OF CARRYING OUT THE INVENTION

Figure 2:
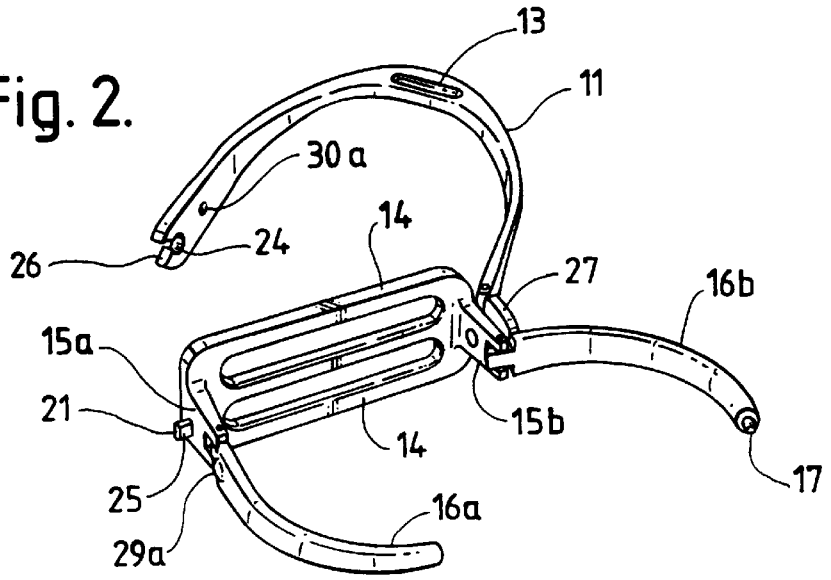
FIG. 2 is a perspective view of the stirrup of FIG. 1 depicting a foot releasing configuration.
Figure 1:
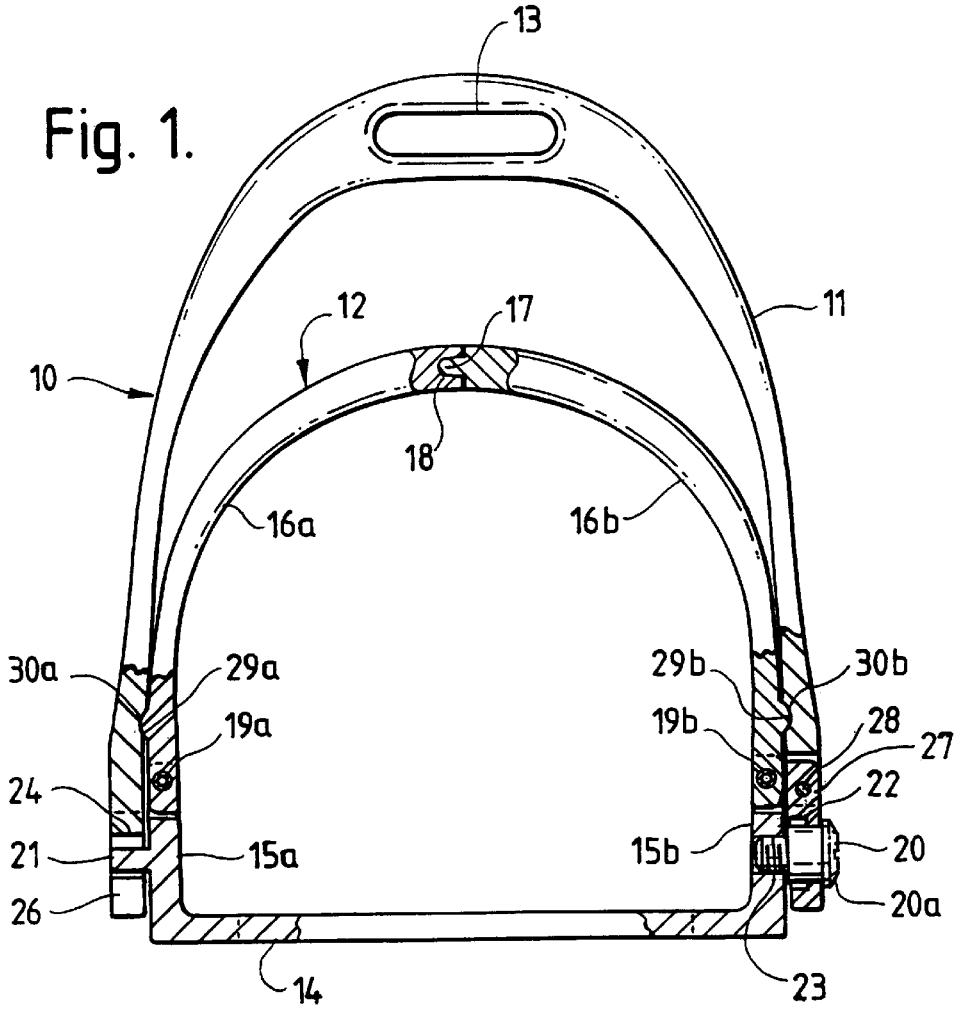
FIG. 1 is an elevational view in partial section of a safety stirrup in its normal in use configuration and constructed in accordance with the present invention.

Referring to FIGS. 1 and 2 in which like numbered parts indicate the same features, the safety stirrup 10 comprises an inverted U-shaped mounting member 11 with a foot support 12 provided between the extremities thereof. A slot 13 is located in the arcuate portion of mounting member 11 for attachment of a stirrup strap (not illustrated) in a known manner.

Foot support 12 consists of a tread 14 having projecting extensions 15*a* and 15*b*, and arms 16*a* and 16*b* together constituting the foot upper restraining portion of the foot support. Arms 16*a* and 16*b* can interlock by virtue of pin 17 at the end of one arm which is received by a recess 18 in the end of the other arm (not shown in FIG. 2). Arms 16*a* and 16*b* are pivotally connected to projecting extensions 15*a* and 15*b* via roll pins 19*a* and 19*b*.

The foot support 12 can pivot between the extremities of mounting member 11 by means of screw 20 and pin 21. Screw 20 has an enlarged collar portion 22 which can rotate in an aperture in mounting member 11. The threaded portion 23 of the screw retains the screw in projecting extension 15*b* of the foot support. The mounting member extremity is retained by head 20*a* of screw 20. A gap is provided between the underside of head 20*a* and the adjacent surface of mounting member 11 to allow slight outward movement of the extremity of the member during pivoting of foot support 12 out of the normal in use position.

On the other side of the foot support, pin 21, which extends from projecting extension 15*a*, is located in aperture 24 when the stirrup is in normal use. Pin 21 has flattened sides, one of which is shown at 25 of FIG. 2. The mounting member extremity having aperture 24 also has a slot extending between the aperture and the edge of the mounting member. The slot can be seen more clearly in FIG. 2 and an angled face of the slot is indicated at 26.

The mounting member extremity opposite the extremity having aperture 24 is pivotable with respect to the rest of the mounting member. The pivotable portion 27 of mounting member 11 is connected to the mounting member via pin 28.

The flattened portions of pin 21 in conjunction with pivotal portion 27 of mounting member 11, allow the pin to be released from aperture 24 when the pin is sufficiently rotated to align the flattened portions with the slot in the mounting member extremity.

Co-operative engagement means are provided between arms 16*a* and 16*b* of foot support 12 and the mounting member 11 to retain the foot support in a plane within the mounting member when the stirrup is in normal use. Such means comprises dimple projections 29*a* and 29*b* on each of the arms and sockets 30*a* and 30*b* formed in the mounting member. In normal use, the dimple projections 29*a* and 29*b* are retained within the sockets 30*a* and 30*b* by virtue of the mounting member being spring biased against the arms 16*a* and 16*b* of the foot support 12.

In normal use, that is, with the stirrup arranged as depicted in FIG. 1, the rider's foot is inserted through the stirrup from either side to a position where the sole of the foot rests on tread 14 and the foot upper contacts the loop, the foot upper restraining portion of the foot support, formed by arms 16*a* and 16*b*. Pivoting of the foot support 12 is prevented during normal riding due to the downward pressure of the foot on the foot support and the spring biasing of the mounting member against the arms of the foot support which ensures that the co-operative engagement means, viz the dimple projections 29*a* and 29*b* and sockets 30*a* and 30*b*, are maintained in close abutment.

When the rider is thrown from the saddle, reorientation of the rider's foot from a substantially horizontal riding position to an inclined position causes a turning force to be exerted by the rider's foot against the foot support 12. This turning force is sufficient to overcome the spring biasing force retaining the dimple projections 29*a* and 29*b* in the sockets 30*a*, 30*b* and the entire foot upper restraining means pivots out of the plane of the mounting member 11 to a position such as indicated in FIG. 2. Simultaneous with such pivoting, once the foot support arms have passed the sides of the mounting member 11, the force imposed by the foot causes the arms 16*a*, 16*b* to immediately pivot outwardly from each other about their pivot points and/or the foot support to be released from the mounting member extremity having aperture 24 with pivoting of portion 27. Consequently, the rider's foot is released from the stirrup.

In this manner, the rider's foot is prevented from being caught in the stirrup after inadvertent dismounting, thus reducing the possibility of injury to the rider. Furthermore, the stirrup is such that it can readily be returned to its normal in use position by simply pivoting the two arms 16*a*, 16*b* together, repositioning pin 21 in aperture 24, and rotating the foot support back to the plane of the mounting member by mere hand manipulation. This is possible since the spring biasing force exerted by the mounting portion can readily be overcome by simple hand exertion.

This is particularly important to enable the rider to immediately remount after being thrown from the saddle.

Figure 3:
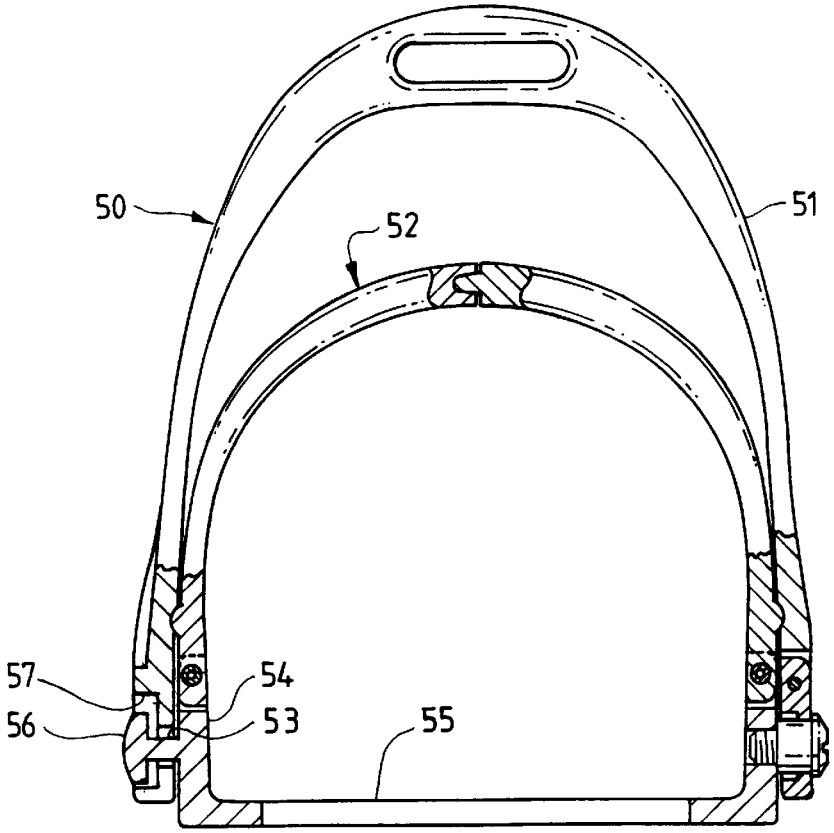
FIG. 3 is an elevational view in partial section of another safety stirrup according to the invention in normal in use configuration.

Referring now to FIG. 3, there is shown safety stirrup 50 having U-shaped mounting member 51 and foot support 52. With the exception of the pivot pin at the bottom left of the stirrup depicted in the figure, all other features of the stirrup are essentially the same as the stirrup depicted in FIGS. 1 and 2.

Pin 53 extends from projecting extension 54 of tread 55 of foot support 52 of FIG. 3 like pin 21 of FIGS. 1 and 2. However, pin 53 has a head 56 which can be received by a recess 57 in the outward face of the extremity of mounting member 51. It can be appreciated from FIG. 3 that a gap is allowed between the underside of head 56 and the bottom of recess 57 to permit some outward movement of the extremity of mounting member 51 when foot support 52 disengages therefrom.

Figure 4:
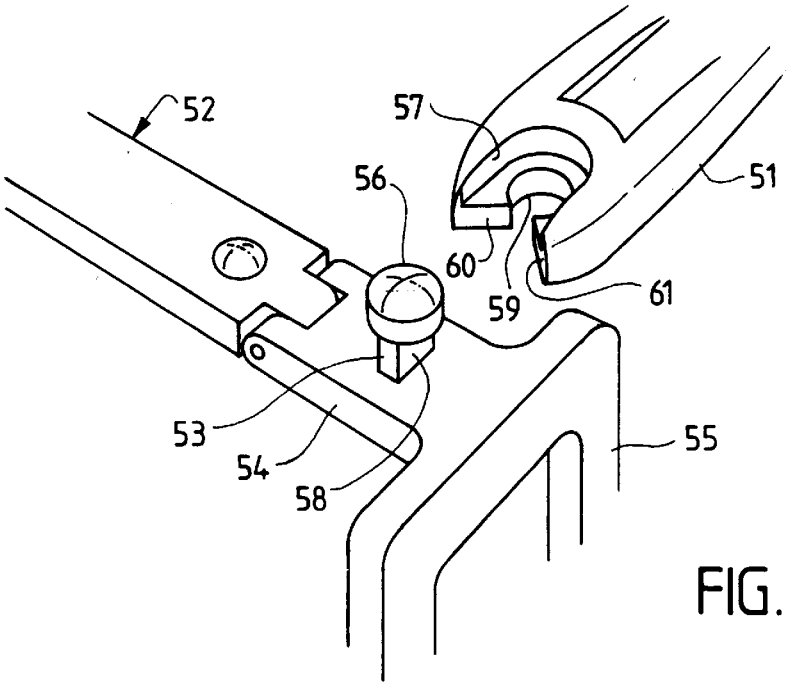
FIG. 4 is a perspective view showing detail of a portion of the stirrup depicted in FIG. 3.

Detail of how pin 53 can be retained by mounting member 51 and pivotally released therefrom is provided in FIG. 4 where like items are identically numbered with respect to FIG. 3. Portions of mounting member 51 and foot support 52 can be seen, the latter including portion of tread 55. Pin 53, which can be seen projecting from projecting extension 54, has flattened sides, one of which is indicated at 58. Recess 57 can be seen in the extremity of mounting member 51 shown in FIG. 4 plus aperture 59. Aperture 59 has a slot therein through which pin 53 can pass when sufficiently rotated to align the flattened sides with the slot. As in the FIGS. 1 and 2 stirrup, faces 60 and 61 of the slot flare outwardly away from aperture 59 to facilitate disengagement of pin 53 from aperture 59 or fitting of the pin into the aperture.

It can be appreciated that recess 57 is open on the side corresponding to the slot in aperture 59 to permit release of head 56 from the recess.

It can be also appreciated from FIGS. 2 and 4 that tread 14 of the stirrup shown in the former figure includes three cross-pieces whereas tread 55 of the FIG. 4 stirrup includes two cross-pieces.

While the foregoing describes preferred embodiments of the invention, various modifications can be included without departing from the spirit of the invention. The releasable securing means for example, could include a variable biasing facility such that the stirrups would require very little force to open for novice riders, but much greater force to open for experienced riders.

We claim:

1. A safety stirrup comprising:

an inverted U-shaped mounting member having means located in the arcuate portion of the U to enable a stirrup strap to be attached thereto;

a foot support pivotally mounted between the extremities of the mounting member when the stirrup is in normal use, wherein the foot support comprises a tread having an extension projecting upwardly from each end of the tread, and a foot upper restraining portion comprising two arms which co-operate together to form a looped configuration extending from the extensions formed on the tread, each said arm being pivotal outwardly from its adjacent projecting extension; and co-operating engagement means between the foot upper restraining portion and the inverted U-shaped mounting member to retain the foot upper restraining portion in a plane within the inverted U-shaped mounting member when the stirrup is in said normal use and to thereby prevent the arms of the foot upper restraining portion from pivoting outward;

wherein said foot support is releasable from said pivotal mounting at one extremity of said mounting member after pivoting of said foot support from the normal in use arrangement and the other extremity of said mounting member is pivotal outwardly, and wherein said pivoting of the foot support from the normal in use arrangement either enables the arms of the foot upper restraining portion to pivot outwardly or enables said foot support to release from said one extremity of said mounting member, or enables the arms of the foot upper restraining portion to pivot outwardly and said foot support to release from said one extremity of said mounting member.

2. Stirrup according to claim 1, wherein said pivotal mounting of said foot support to said mounting member is by way of shafts or pins.

3. Stirrup according to claim 2, wherein said pins or shafts extend from, or are received by, said extensions projecting from said tread.

4. Stirrup according to claim 1, wherein said pivotal mounting of the foot support which is releasable from one extremity of the mounting member comprises a pin projecting from said foot support which is received by an aperture in said mounting member.

5. Stirrup according to claim 4, wherein opposite sides of said pin are flattened which on rotation of said foot support, allow said pin to pass through a slot in said mounting member between said aperture and an edge of said mounting member.

6. Stirrup according to claim 5, wherein walls of said slot fare outwardly away from said aperture.

7. Stirrup according to claim 6, wherein the angle between said slot walls is about 45°.

8. Stirrup according to claim 4, wherein said pin has a head which prevents excessive spreading of the extremities of said mounting member when said pin is located in said aperture in said mounting member.

9. Stirrup according to claim 8, wherein said head is received by a recess formed in said mounting member.

10. Stirrup according to claim 1, wherein said pivotal mounting of the foot support to the other extremity of the mounting member comprises a screw which passes from the exterior of said stirrup through said mounting member to be threadingly engaged by said foot support.

11. Stirrup according to claim 10, wherein said screw is contained within a dual diameter cavity in said mounting member with said screw having an enlarged head which recesses into the wider diameter of said cavity.

12. Stirrup according to claim 1, wherein said upper restraining portion is arcuate in shape and wherein said arms co-operate in a male/female arrangement.

13. Stirrup according to claim 12, wherein said male/female arrangement comprises an integrally formed pin extending from a tip of one of said arms which is accommodated in a complementary-shaped recess formed in the tip of the other of said arms.

14. Stirrup according to claim 1, wherein said co-operating engagement means comprises a projection formed on each arm of the foot upper restraining portion adjacent to the pivotal connection with the support extension, and an aligned socket formed in the inwardly facing arms of the inverted U-shaped mounting member.

15. Stirrup according to claim 14, wherein said projection is maintained within the socket to thereby prevent pivotal rotation of the foot upper restraining means from the plane of the mounting member during normal use, by spring-biasing the sides of the mounting member against the restraining means.

16. Stirrup according to claim 1, wherein said pivot between a restraining portion arm and adjacent projecting extension, and the other extremity of the mounting member and the remainder of the mounting member, comprises interdigitating elements through which a pin is passed.

* * * * *